United States Patent [19]

Arai et al.

[11] Patent Number: 4,683,844

[45] Date of Patent: Aug. 4, 1987

[54] CYLINDER BLOCK AND HEAD ASSEMBLY FOR INTERNAL COMBUSTION ENGINES

[75] Inventors: Takeo Arai; Nobuo Anno; Yusuke Kinoshita; Yukio Kusakabe, all of Saitama, Japan

[73] Assignee: Honda Giken Kogyo Kabushiki Kaisha, Tokyo, Japan

[21] Appl. No.: 807,868

[22] Filed: Dec. 11, 1985

[30] Foreign Application Priority Data

Dec. 11, 1984 [JP] Japan ..... 59-261642
Dec. 29, 1984 [JP] Japan ..... 59-279651

[51] Int. Cl.[4] ..... F01P 3/02

[52] U.S. Cl. ..... 123/41.74; 123/41.82 R; 277/235 B

[58] Field of Search ..... 123/195 R, 41.28, 41.74, 123/41.79; 277/235 B

[56] References Cited

U.S. PATENT DOCUMENTS 4,211,205 7/1980 Lockhart ..... 277/235 B
4,365,593 12/1982 Pomfret ..... 123/41.79

FOREIGN PATENT DOCUMENTS 2714777 10/1978 Fed. Rep. of Germany ... 277/235 B

*Primary Examiner*—William A. Cuchlinski, Jr.
*Attorney, Agent, or Firm*—Lyon & Lyon

[57] ABSTRACT

A cylinder block and head assembly for use in an internal combustion engine includes a closed-deck cylinder block having a deck and a water jacket, a cylinder head mounted on the deck and having a water jacket, and a gasket interposed between the cylinder block and the cylinder head. Communication passages are defined in the cylinder block, the cylinder head, and the gasket and provide communication between the water jackets in the cylinder block and the cylinder head. Recesses are defined adjacent to the communication passages and between the cylinder block and the cylinder head for increasing the pressure on the surfaces of the gasket between the cylinder block and the cylinder head through a reduction in the area of contact between the gasket surfaces and the cylinder block and head. In alternate embodiments the gasket or the cylinder block has holes providing communication between the recesses and the communication passages. Since the pressure on the gasket is increased per unit area, the gasket is highly effective in preventing a cooling liquid or oil from leaking out from between the cylinder block and the cylinder head.

13 Claims, 11 Drawing Figures

CYLINDER BLOCK AND HEAD ASSEMBLY FOR INTERNAL COMBUSTION ENGINES

The present invention relates to a cylinder block and head assembly having a closed-deck cylinder block for use in an internal combustion engine.

Cylinder blocks for water-cooled internal combustion engines are generally classified into open-deck cylinder blocks and closed-deck cylinder blocks. In the open-deck cylinder blocks, the water jacket for cooling the cylinder block has its upper end open substantially entirely at the upper surface, or the deck, of the cylinder block. In the closed-deck cylinder blocks, the upper end of the water jacket is substantially closed with only water passages open at the deck for communication with a cylinder head.

The closed-deck cylinder blocks for water-cooled internal combustion engines are known as disclosed in U.S. Pat. No. 4,369,739. There is also known a cylinder block and head assembly as disclosed in Japanese Utility Model Publication No. 56(1981)-44251, the assembly having a cylinder block and a cylinder head which are joined to each other with a gasket interposed therebetween. The cylinder block and head assembly also has grooves defined between the cylinder block and the gasket or between the cylinder head and the gasket.

The closed-deck cylinder blocks are particularly suitable for use in automotive multicylinder engines of a high power output capability since the deck that serves as a surface for attachment to the cylinder head is of a high rigidity and therefore durability of the gasket to be inserted between the cylinder block and the cylinder head is increased. However, the increased area of contact between the deck surface of the cylinder block and the gasket and also between the lower surface of the cylinder head and the gasket reduces the pressure acting on the surface of the gasket per unit area, thus lowering the sealing capability of the gasket or resulting in a greater danger of coolant or oil leakage. One solution would be to increase the force with which the cylinder block and the cylinder head are fastened together by bolts. However, the bolts would be required to be larger and heavier, and hence the assembling process would be less efficient, with the consequence that the cost of assembly would be increased. Another known way of compensating for a reduction in the pressure acting on the gasket surface is to coat the gasket with a resin layer by dipping or printing with a view to preventing coolant and oil leakage. This arrangement is also disadvantageous in that the cost of manufacture is increased.

It is an object of the present invention to provide a cylinder block and head assembly for internal combustion engines which has a simple structure for increasing the pressure acting on a gasket between the cylinder block and the cylinder head.

According to the present invention, a cylinder block and head assembly for use in an internal combustion engine includes a closed-deck cylinder block having a deck and a first fluid chamber, a cylinder head disposed on the deck and having a second fluid chamber, and a gasket interposed between the cylinder block and the cylinder head. Communication passages are defined in the cylinder block, the cylinder head, and the gasket and provide communication between the first and second fluid chambers. Recesses are defined adjacent to the communication passages and between the cylinder block and the cylinder head for increasing the pressure on the surfaces of the gasket between the cylinder block and the cylinder head through a reduction in the area of contact between the gasket surfaces and the cylinder block and head. In alternate forms of the invention, the gasket or the cylinder block has holes providing communication between the recesses and the communication passages.

Since the pressure on the gasket is increased per unit area, the gasket is highly effective in preventing cooling liquid or oil from leaking out from between the cylinder block and the cylinder head.

The above and other objects, features and advantages of the present invention will become more apparent from the following description when taken in conjunction with the accompanying drawings in which preferred embodiments of the present invention are shown by way of illustrative example.

Like or corresponding parts are denoted by like or corresponding reference characters throughout the views of the various embodiments of the invention.

FIGS. 1 through 4 illustrate a cylinder block and head assembly according to a first embodiment of the present invention, the cylinder block and head assembly being incorporated in an in-line four-cylinder internal combustion engine although it will readily appear to those skilled in the art that the invention is equally applicable to other cylinder arrangements.

Figure 3:
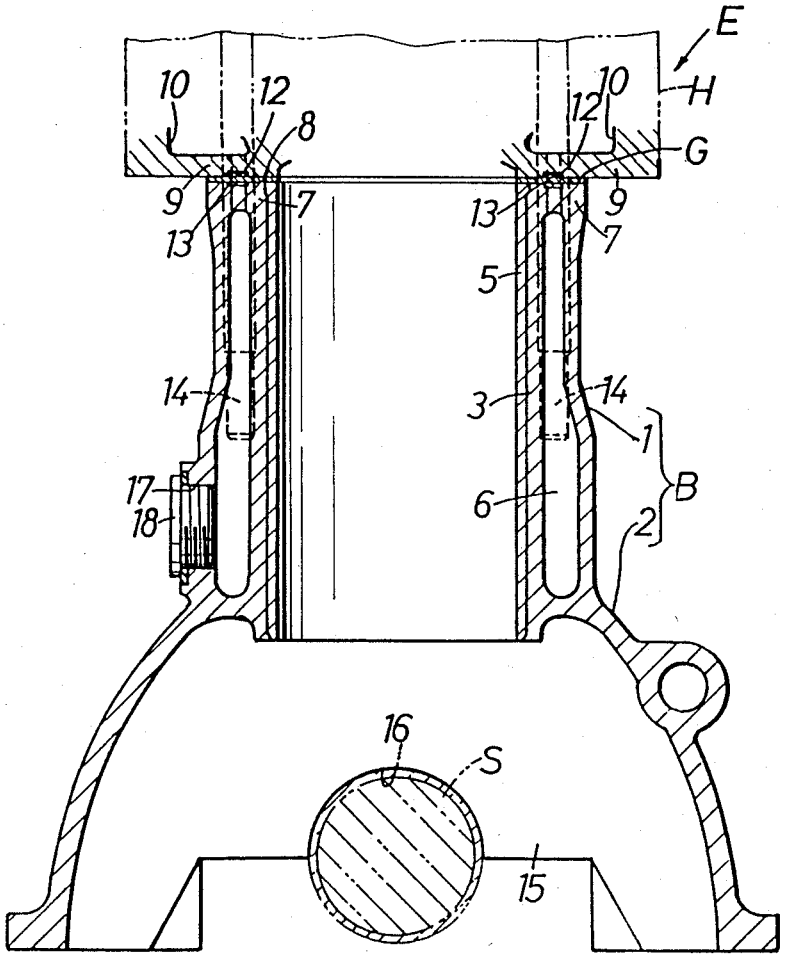
FIG. 3 is a cross-sectional view taken substantially along line III—III of FIG. 2 but also showing a portion of the cylinder head.

As shown in FIG. 3, the cylinder block and head assembly, generally designated at E, comprises a cylinder block B and a cylinder head H mounted on and coupled to the cylinder block B with a gasket G interposed therebetween.

The cylinder block B preferably is integrally cast of an aluminum alloy such as by the casting process as disclosed in U.S. Pat. Nos. 4,436,140 and 4,519,436. The cylinder block B generally comprises an upper cylinder-defining portion 1 and a lower crankcase-defining portion 2. The cylinder-defining portion 1 has four in-line cylinder bores 3 defined therein in the so-called Siamese configuration with no water jackets in boundary walls 5 between the adjacent cylinder bores 3.

A tubular cylinder liner 4 is fitted in each of the cylinder bores 3, and a piston (not shown) is slidably fitted in the tubular cylinder liner 4.

The cylinder-defining portion 1 also has a water jacket 6 defined in surrounding relation to the cylinder bores 3 except at the boundary walls 5 between the adjacent cylinder bores 3. As shown in FIG. 3, the water jacket 6 extends substantially the entire length of each of the cylinder bores 3.

The cylinder block B, which is of the closed-deck type, has an upper wall 7 of a prescribed wall thickness extending over the water jacket 6, with the upper wall 7 having an upper surface serving as a deck 8 to which the cylinder head H is coupled.

Figure 4:
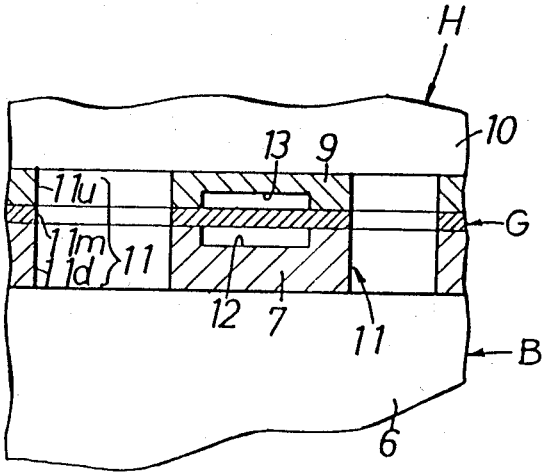
FIG. 4 is an enlarged fragmentary cross-sectional view taken substantially along line IV—IV of FIG. 2 but also showing a portion of the cylinder head.

The cylinder head H is fastened to the deck 8 by a plurality of fastening bolts 14 with the gasket G sandwiched between a lower wall 9 of the cylinder head H and the deck 8. The upper wall 7 of the cylinder block B, the gasket G, and the lower wall 9 of the cylinder head H have a plurality of communication passages 11 defined therein and through which the water jacket 6 communicates with a water jacket 10 in the cylinder head H. As shown in FIG. 4, each of the communication passages 11 has a lower hole **11*d* defined in the upper wall 7 of the cylinder block B and opening into the water jacket 6, a middle hole 11*m* defined in the gasket G, and an upper hole 11*u* defined in the lower wall 9 of the cylinder head H and opening into the water jacket 10. The upper, middle, and lower holes 11*u*, 11*m*, 11*d* are of equal sizes and held in registry with each other. A cooling liquid or coolant in the water jackets 6 and 10 can flow therebetween through the communication passages 11**.

Figure 1:
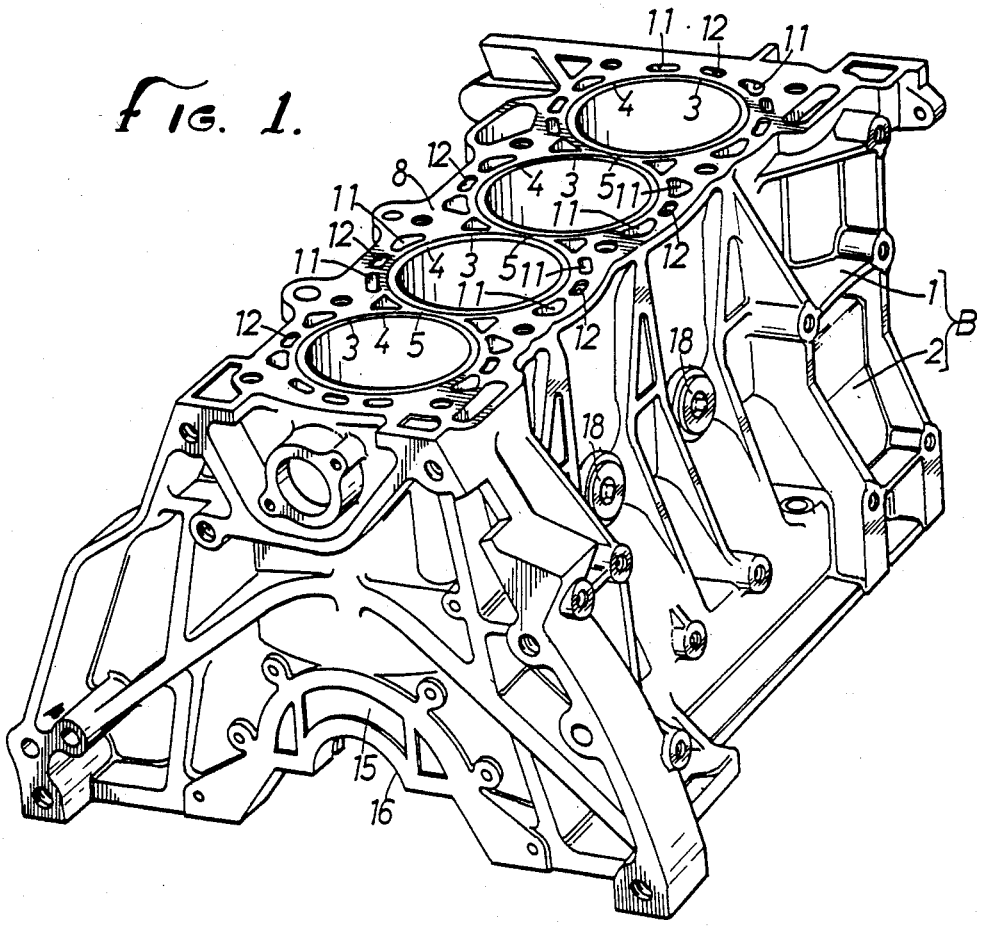
FIG. 1 is a perspective view of a cylinder block of the cylinder block and head assembly according to a first embodiment of the present invention.
Figure 2:
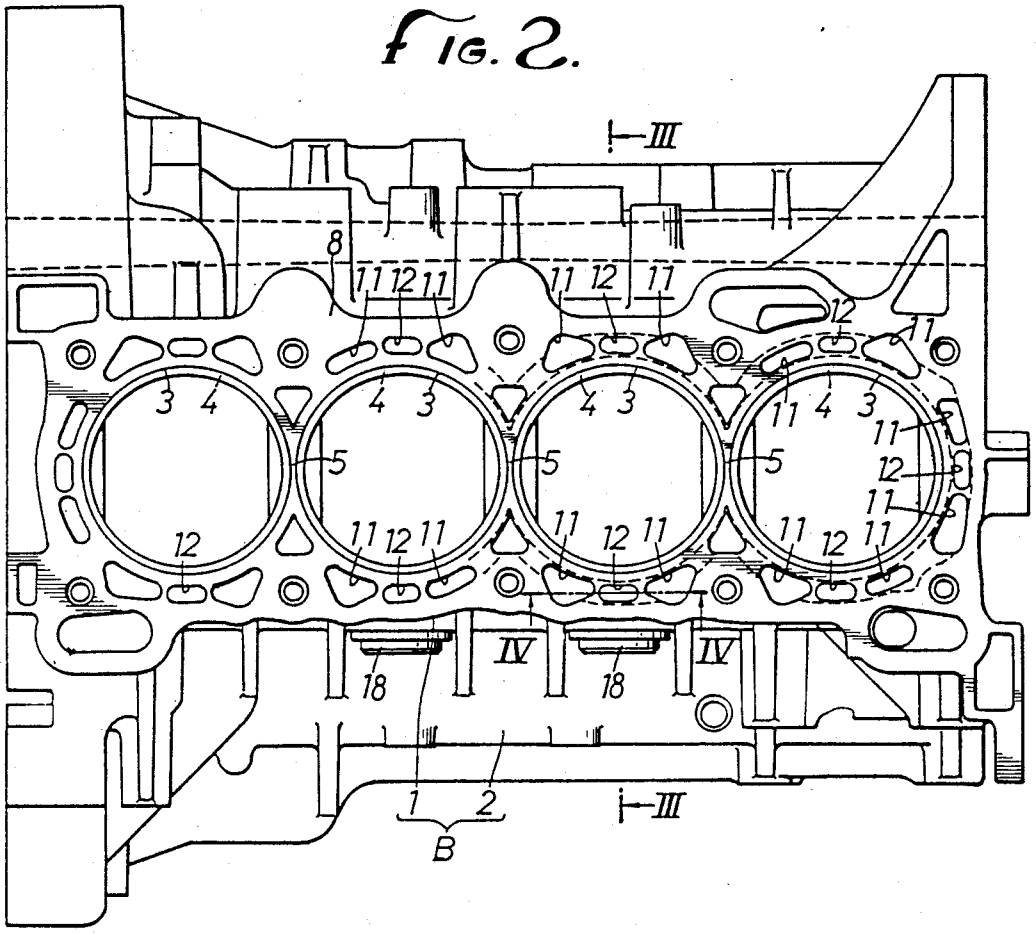
FIG. 2 is a plan view of the cylinder block shown in FIG. 1.

The upper wall 7 of the cylinder block B has a plurality of recesses 12 defined in the upper surface or deck 8 thereof and opening upwardly toward the gasket G. The lower wall 9 of the cylinder head H has a plurality of recesses 13 defined in the lower surface thereof and opening downwardly toward the gasket G. The recesses 12 and 13 in each pair are held in vertical registry with each other, with the gasket G therebetween, as shown in FIGS. 3 and 4, and are positioned between adjacent two of the communication passages 11 as shown in FIGS. 1 and 2.

The recesses 12 do not communicate with the water jackets 10 and 6, as is illustrated in FIG. 4; that is, the recesses 12 are not only separated from but are isolated from the water jackets 10 and 6. The recesses 12 and 13 reduce the area of contact between the upper surface or deck 8 of the cylinder block B and the lower surface of the gasket G and also between the lower surface of the cylinder head H and the upper surface of the gasket G, thus increasing the pressure acting therebetween or on the surfaces of the gasket G per unit area. This in turn increases the sealing effectiveness of the gasket G without increasing the bolt size or number, or the applied torque on the bolts 14.

The lower crankcase-defining portion 2 of the cylinder block B has a plurality of integral journal walls 15 spaced at intervals along the direction in which the cylinder bores 3 are arranged in line. The journal walls 15 have semicircular bearing recesses 16 defined respectively in the central lower surfaces thereof and opening downwardly for supporting a crankshaft S.

The water jacket 6 is formed by a core in the form of a sand mold when the cylinder block B is cast. The outer side wall (shown on the lefthand side in FIG. 3) of the cylinder block B has a hole 17 for supporting the core through a mold (not shown) and removing the core therethrough after the cylinder block B has been cast. The hole 17 is closed off by a blind plug 18 after the core has been removed.

When the engine is operated, the cooling liquid in the water jackets 6 and 10 flows through the communication passages 11 to cool the cylinder block and head assembly E.

The sealing capability of the gasket G is improved since the pressure acting thereon per unit area is increased due to the reduced area of contact achieved by the recesses 12 and 13 between the cylinder block B and the gasket G and between the cylinder head H and the gasket G. Therefore, the cooling liquid flowing through the communication passages 11 is prevented from leaking out from between the cylinder block B and the cylinder head H.

Since the cylinder block B is of the closed-deck type, the cylinder block and head assembly E is very rigid and the durability of the gasket G is improved. The pressure on the surfaces of the gasket G per unit area is increased by the reduced area of contact between the cylinder block B and the gasket G and also between the cylinder head H and the gasket G. Consequently, the sealing ability of the gasket G is increased without fastening the cylinder block B and the cylinder head H together with larger forces, so that the gasket G can reliably prevent leakage of the cooling liquid.

Figure 5:
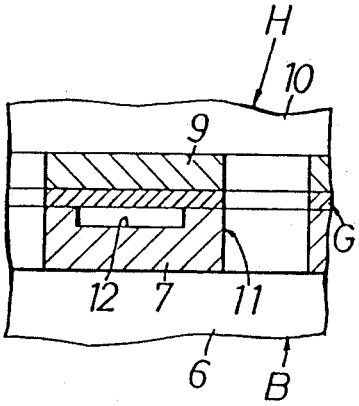
FIG. 5 is a view similar to FIG. 4, showing a cylinder block and head assembly according to a second embodiment of the present invention.

FIG. 5 shows a cylinder block and head assembly according to a second embodiment of the present invention. In the second embodiment, only the recesses 12 are provided in the upper surface or deck of the upper wall 7 of the cylinder block B for increasing the pressure on the gasket G, and no recesses are defined in the lower surface of the lower wall 9 of the cylinder head H.

As in the embodiment of FIG. 4, the recesses 12 of FIG. 5 do not communicate with the water jackets 10 and 6; that is, the recesses 12 are not only separated from but are isolated from the water jackets 10 and 6.

Figure 6:
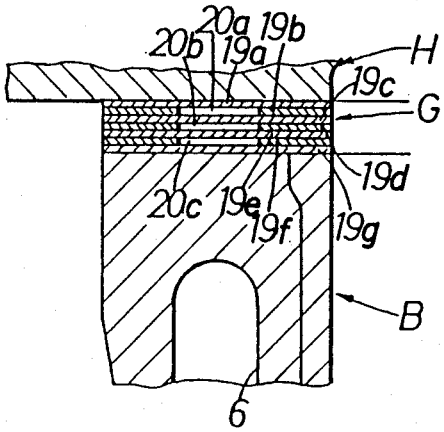
FIG. 6 is a view similar to FIG. 4, showing a cylinder block and head assembly according to a third embodiment of the present invention.

According to a third embodiment illustrated in FIG. 6, a gasket G interposed between the cylinder block B and the cylinder head H is of a laminated structure comprising a plurality of thin gasket sheets, such as for example the seven gasket sheets numbered **19*a* through 19*g*. The alternate gasket sheets 19*b*, 19*d* and 19*f*, each sandwiched between adjacent gasket sheets, have holes or recesses 20*a*, 20*b* and 20*c* which are vertically aligned. The recesses 20*a*, 20*b* and 20*c* are located adjacent to the communication passages 11 (FIGS. 1, 2 and 4) similar to the locations of recesses 12 and 13** for increasing the pressure on the surfaces of the gasket G between the cylinder block B and the cylinder head H.

As in the embodiments of FIGS. 4 and 5, the recesses **20*a*, 20*b* and 20*c* of FIG. 6 are separated and isolated from the water jackets 10 and 6**.

Although not shown, recesses for increasing the pressure on the gasket may also be defined adjacent to other passages for lubricating oil and blowby gas, which provide communication between fluid chambers in the cylinder block B and the cylinder head H.

FIGS. 7 through 10 illustrate a cylinder block and head assembly Ea according to a fourth embodiment of the present invention. Since the cylinder block and head assembly Ea is essentially the same as the cylinder block and head assembly E shown in FIGS. 1 through 4, only different structural details will be described below.

The upper wall 7 of the cylinder block B, the gasket G, and the lower wall 9 of the cylinder head H have a plurality of communication passages 21 (FIG. 10) defined therein and through which the water jacket 6 in the cylinder block B communicates with the water jacket 10 in the cylinder head H. Each of the communication passages 21 has a lower hole 21*d* defined in the upper wall 7 of the cylinder block B for communicating with the water jacket 6, a middle hole 21*m* defined in the gasket G, and an upper hole 21*u* defined in the lower wall 9 of the cylinder head H for communicating with the water jacket 10. The upper, middle, and lower holes 21*u*, 21*m* and 21*d* communicate in substantially vertical alignment with each other. A cooling liquid or coolant in the water jackets 6 and 10 can flow therebetween through the communication passages 21. The middle hole 21*m* is smaller than the upper and lower holes 21*u*, 21*d* and controls the rate of flow of the cooling liquid between the upper and lower holes 21*u*, 21*d*.

Figure 7:
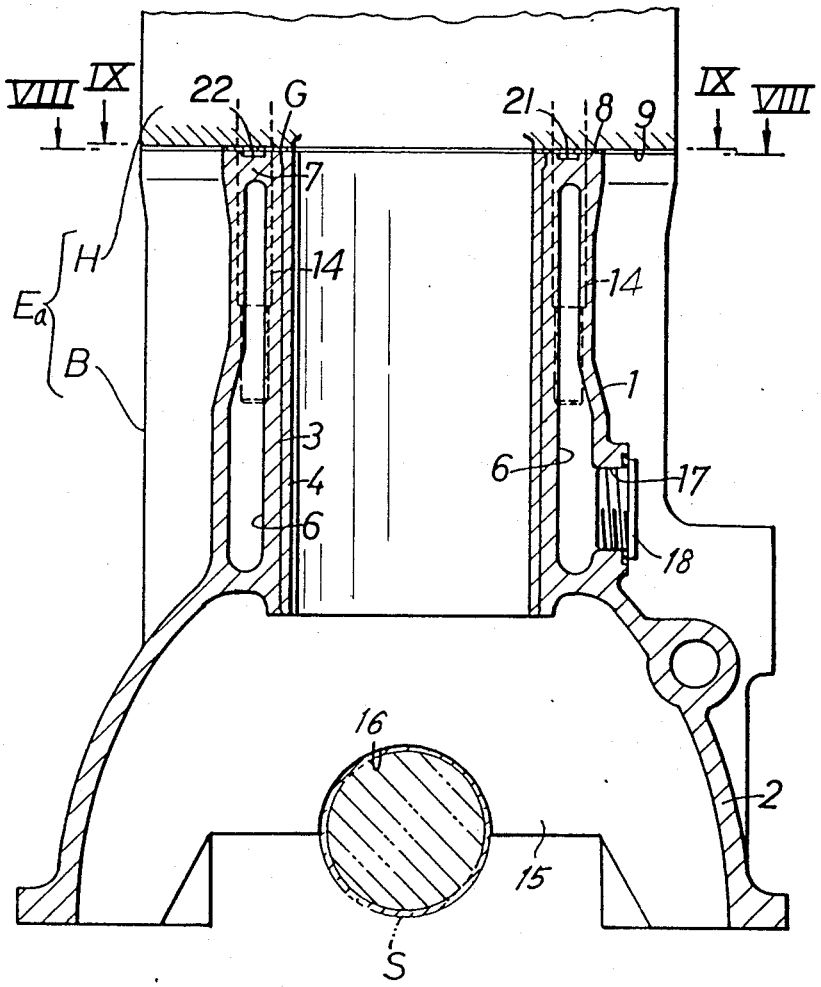
FIG. 7 is a fragmentary vertical cross-sectional view similar to FIG. 3 of a cylinder block and head assembly according to a fourth embodiment of the present invention, the view being taken substantially along line VII—VII of FIG. 8.
Figure 8:
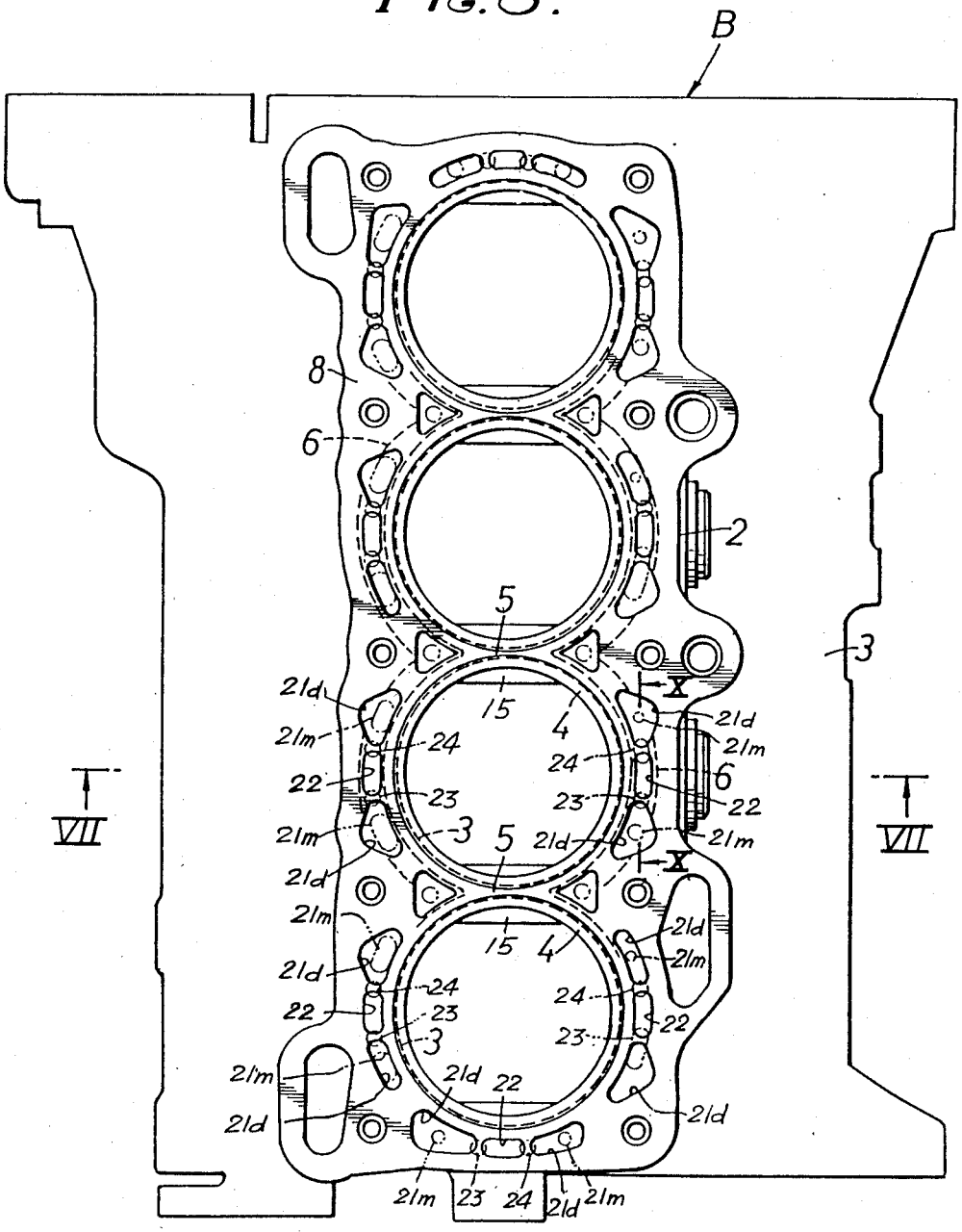
FIG. 8 is a plan view of a cylinder block, taken along line VIII—VIII of FIG. 7.
Figure 10:
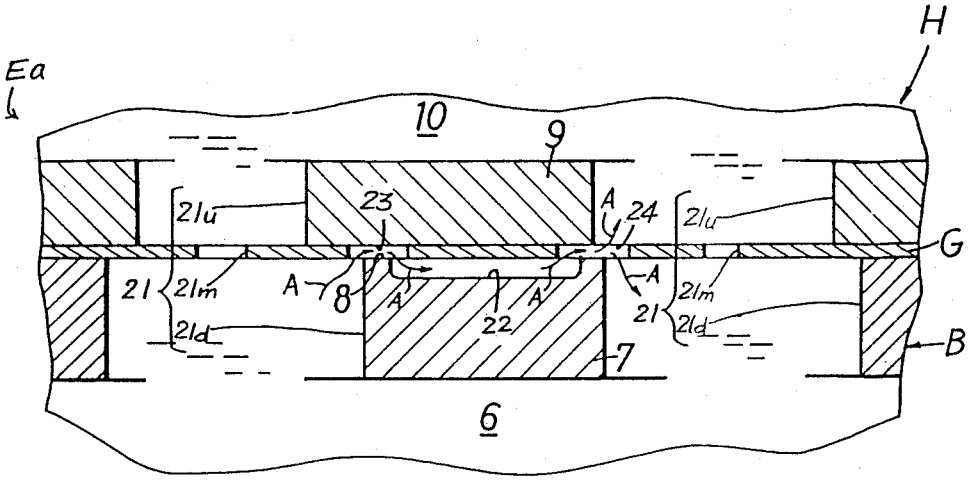
FIG. 10 is an enlarged fragmentary cross-sectional view taken along line X—X of FIG. 8 but also showing a portion of the cylinder head.

The upper wall 7 of the cylinder block B has a plurality of recesses 22 defined in the upper surface or deck 8 thereof, as shown in FIGS. 7, 8 and 10. The recesses 22 serve to reduce the area of contact between the upper surface 8 of the cylinder block B and the gasket G and also between the lower surface of the cylinder head H and the gasket G for thereby increasing the pressure acting on the surfaces of the gasket G per unit area.

Figure 9:
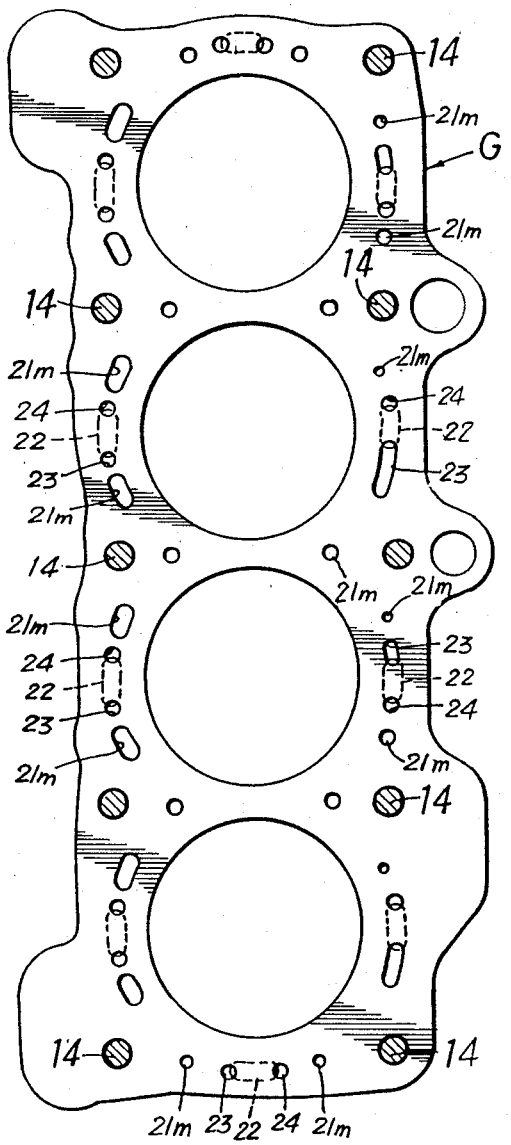
FIG. 9 is a plan view of a gasket, taken along line IX—IX of FIG. 7.

As illustrated in FIGS. 8 through 10, the gasket G has a plurality of holes 23 defined therethrough for providing communication between the lower holes 21*d* and the recesses 22, and a plurality of holes 24 defined therethrough for providing communication between the recesses 22 and the upper and lower holes 21*u* and 21*d*. The cooling liquid can flow between the water jackets 6 and 10 through the hole 23, the recess 22, and the hole 24, as indicated by the arrows A.

During operation of the engine, the cooling liquid in the water jackets 6 and 10 flows through the communication passages 21 for cooling the cylinder block and head assembly Ea. The sealing capability of the gasket G is improved since the pressure acting thereon per unit area is increased due to the reduced area of contact achieved by the recesses 22. Therefore, the cooling liquid flowing through the communication passages 21 is prevented from leaking out from between the cylinder block B and the cylinder head H.

As shown in FIG. 10, part of the cooling liquid continuously flows from the water jacket 6 through the lower hole 21*d* and the hole 23 into the recess 22 and then from the recess 22 through the hole 24 and the upper and lower holes 21*u* and 21*d* into the water jackets 10 and 6, as indicated by the arrows A. The recess 22 thus communicates with the water jackets 10 and 6 indirectly through the communication passages 21; that is, the recess 22 is separated from but not isolated from the water jackets 10 and 6 by the communication passages 21. Therefore, no air is trapped in the recess 22 and the cooling liquid is prevented from remaining stagnant in the recess 22 because the recesses 22 are not isolated from the water jackets 10 and 6. Further, the cooling liquid is thus prevented from being boiled in the recess 22, and no thermal expansion of air is caused in the recess 22. Accordingly, the cylinder block B and the cylinder head H are prevented from becoming eroded and hence from lowering their sealing capability, with the result that the ability of the upper wall of the cylinder block B, the lower wall of the cylinder head H, and the gasket G to retain the cooling liquid can be improved.

Figure 11:
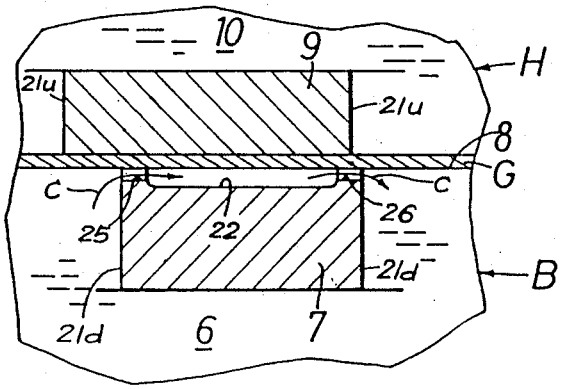
FIG. 11 is a view similar to FIG. 10, illustrating a cylinder block and head assembly according to a fifth embodiment of the present invention.

FIG. 11 illustrates a fifth embodiment of the present invention which is a variation of the fourth embodiment of FIGS. 7–10. The upper wall 7 of the cylinder block B has a plurality of holes 25 and 26 defined in the upper surface thereof for providing communication between the recess 22 and the lower holes 21*d*. The cooling liquid flows between the recess 22 and the lower holes 21*d* through the holes 25 and 26 as indicated by the arrows C. As in the embodiment of FIG. 10, the recess 22 thus communicates indirectly with the water jackets 10 and 6 and is thus separated from the water jackets 10 and 6. Inasmuch as the cooling liquid continuously flows through the recess 2 during operation of the engine, no air is trapped and no cooling liquid remains stagnant in the recess 22.

Although certain preferred embodiments have been shown and described, it should be understood that many changes and modifications may be made therein without departing from the scope of the appended claims.

What is claimed:

1. A cylinder block and head assembly for use in an internal combustion engine, comprising:

a closed-deck cylinder block having a deck and a first fluid chamber;

a cylinder head disposed on said deck and having a second fluid chamber;

a gasket interpose between said cylinder block and said cylinder head;

communication passages defined in said cylinder block, said cylinder head, and said gasket for providing communication between said fluid chambers; and means defining recesses adjacent to said communication passages and between said cylinder block and said cylinder head for increasing the pressure on the surfaces of said gasket between said cylinder block and said cylinder head, said recesses being separate from both of said first and second fluid chambers.

2. A cylinder block and head assembly according to claim 1, wherein said cylinder block has an upper wall including said deck as an upper surface thereof and said cylinder head has a lower wall, said gasket being sandwiched between said upper and lower walls, each of said communication passages comprising an upper hole defined in said lower wall of the cylinder head, a middle hole defined in said gasket, and a lower hole defined in said upper wall of said cylinder block.

3. A cylinder block and head assembly according to claim 2, wherein said upper, middle, and lower holes are of equal sizes and held in registry with each other.

4. A cylinder block and head assembly according to claim 2, wherein said middle hole is smaller than said upper and lower holes.

5. A cylinder block and head assembly according to claim 2, wherein said recesses are defined in said upper and lower walls.

6. A cylinder block and head assembly according to claim 2, wherein said recesses are defined in said upper walls.

7. A cylinder block and head assembly according to claim 2, wherein said recesses are defined in said lower walls.

8. A cylinder block and head assembly according to claim 2, wherein said recesses are defined in said gasket.

9. A cylinder block and head assembly according to claim 8, wherein said gasket comprises a laminated structure including a plurality of gasket sheets, said recesses being defined respectively in alternate ones of said gasket sheets.

10. A cylinder block and head assembly according to claim 2, wherein said gasket has a plurality of holes providing communication between said recesses and said upper and lower holes.

11. A cylinder block and head assembly for use in an internal combustion engine, comprising, the cylinder block being of the closed-deck type and having an upper surface, the head having a lower surface facing said block upper surface, a gasket positioned between said upper and lower surfaces, coolant passages through said upper and lower surfaces and gasket, and recess means formed between said upper and lower surfaces adjacent said coolant passages for increasing the unit pressure on said gasket form said upper and lower surfaces, said recess means being separate from a first fluid chamber in the cylinder block and a second fluid chamber in the cylinder head with said first and second fluid chambers communicating with one another through said coolant passages.

12. A cylinder block and head assembly for use in an internal combustion engine, comprising:

a closed-deck cylinder block having a deck and a first fluid chamber;

a cylinder head disposed on said deck and having a second fluid chamber;

a gasket interposed between said cylinder block and said cylinder head;

communication passages defined in said cylinder block, said cylinder head, and said gasket for providing communication between said first and second fluid chambers; and means defining recesses adjacent to said communication passages and between said cylinder block and said cylinder head for increasing the pressure on the surfaces of said gasket between said cylinder block and said cylinder head, said recesses being isolated from both of said first and second fluid chambers.

13. A cylinder block and head assembly for use in an internal combustion engine, comprising:

a closed-deck cylinder block having an upper wall including a deck as an upper surface thereof, said block also having a first fluid chamber;

a cylinder head disposed on said deck and having a lower wall and a second fluid chamber;

a gasket sandwiched between said upper wall of said cylinder block and said lower wall of said cylinder head;

communication passages each of which comprises an upper hole defined in said lower wall of said cylinder head, a middle hole defined in said gasket, and a lower hole defined in said upper wall of said cylinder block;

means defining recesses adjacent to said communication passages and between said cylinder block and said cylinder head for increasing the pressure on the surfaces of said gasket between said cylinder block and said cylinder head, said upper wall having a plurality of holes providing communication between said recesses and said lower holes.

* * * * *